US010221031B2

(12) United States Patent
Endo et al.

(10) Patent No.: US 10,221,031 B2
(45) Date of Patent: Mar. 5, 2019

(54) SHEET STACKING APPARATUS

(71) Applicants: CANON FINETECH INC., Misato-shi, Saitama (JP); NISCA CORPORATION, Minamikoma-gun, Yamanashi (JP)

(72) Inventors: Kazunori Endo, Minamikoma-gun (JP); Kenichi Matsuno, Minamikoma-gun (JP); Ikuhiro Obata, Minamikoma-gun (JP); Yuji Kunugi, Minamikoma-gun (JP); Akira Takei, Minamikoma-gun (JP)

(73) Assignee: Canon Finetech Nisca Inc., Misato-shi (JP)

( * ) Notice: Subject to any disclaimer, the term of this patent is extended or adjusted under 35 U.S.C. 154(b) by 0 days.

(21) Appl. No.: 15/245,493

(22) Filed: Aug. 24, 2016

(65) Prior Publication Data

US 2017/0066616 A1 Mar. 9, 2017

(30) Foreign Application Priority Data

Sep. 9, 2015 (JP) ..... 2015-177132

(51) Int. Cl.

| | |
|---|---|
| ***B65H 29/52*** | (2006.01) |
| ***B65H 31/26*** | (2006.01) |
| ***B65H 31/02*** | (2006.01) |
| ***B65H 45/18*** | (2006.01) |
| ***B65H 29/24*** | (2006.01) |

(52) U.S. Cl.

CPC ..... *B65H 29/52* (2013.01); *B65H 29/246* (2013.01); *B65H 31/02* (2013.01); *B65H 31/26* (2013.01); *B65H 45/18* (2013.01); *B65H 2220/09* (2013.01); *B65H 2301/4212* (2013.01); *B65H 2404/61* (2013.01); *B65H 2404/693* (2013.01); *B65H 2405/1111* (2013.01); *B65H 2405/11152* (2013.01); *B65H 2405/1412* (2013.01); *B65H 2701/18271* (2013.01); *B65H 2801/06* (2013.01)

(58) Field of Classification Search

CPC ..... B65H 2405/10; B65H 31/00; B65H 2301/4223; B65H 2301/4222; B65H 31/26; B65H 31/34; B65H 29/52; B65H 31/36; B65H 2301/4212; B65H 31/38; B65H 2405/1412

USPC ..... 271/207, 220, 221

See application file for complete search history.

(56) References Cited

U.S. PATENT DOCUMENTS

| | | | | |
|---|---|---|---|---|
| 7,862,015 B2 * | 1/2011 | Kotani | ..... | B65H 31/26 270/20.1 |
| 2006/0180999 A1 | 8/2006 | Suzuki et al. | | |
| 2008/0099973 A1 * | 5/2008 | Kotani | ..... | B65H 31/26 270/32 |

FOREIGN PATENT DOCUMENTS

| | | |
|---|---|---|
| JP | 2006-143466 A | 6/2006 |
| JP | 2008-184324 A | 8/2008 |
| JP | 2009-051644 A | 3/2009 |

* cited by examiner

*Primary Examiner* — Thomas A Morrison
(74) *Attorney, Agent, or Firm* — Venable LLP

(57) ABSTRACT

A sheet stacking apparatus, including: a conveyance unit configured to convey a sheet; a stacking unit on which a sheet conveyed by the conveyance unit is stacked, the stacking unit inclined downward in a conveyance direction in which the conveyance unit conveys a sheet and including a first region and a second region located downstream of the first region in the conveyance direction; a guide portion configured to guide a sheet conveyed by the conveyance unit (Continued)

over a sheet placed on the second region; and a pressing portion configured to press a sheet placed on the second region.

11 Claims, 5 Drawing Sheets

SHEET STACKING APPARATUS

BACKGROUND OF THE INVENTION

Field of the Invention

The present invention relates to a sheet stacking apparatus configured to stack sheets which are sequentially conveyed.

Description of the Related Art

In an image forming apparatus such as a copying machine, a printer, a facsimile machine, or a digital multi-function device, sheets having images formed thereon are sequentially delivered to a post-processing apparatus. The post-processing apparatus is configured to deliver the introduced sheets directly to a tray and stack the sheets on the tray, or perform various post-processing and stack the sheets on the tray.

Even when a sheet is not subjected to particular processing in the post-processing apparatus, application of heat to the sheet for the purpose of fixing toner in the image forming apparatus may cause the sheet to shrink unevenly, and particularly cause edges of the sheet to roll up and swell (in other words, the edges are curled). Further, steps of the post-processing may include, after aligning edges of conveyed sheets, stapling of saddle stitching, nipping the bound bundle of sheets with a pair of rollers to crease the bundle of sheets, delivering the creased bundle of sheets to a delivery tray, and stacking the bundle of sheets on the delivery tray. Then, when the center-folded sheets are sequentially delivered to the delivery tray, the sheets are introduced to the delivery tray with respective folded portions, which are bent portions, being the leading edges.

However, when the bundle of sheets is center-folded, the bundle of sheets may swell. In particular, such swelling may occur conspicuously at the folded edge of the bundle of sheets. Thus, there is a problem in that a stack height of the bundles of sheets readily exceeds a mechanical size limit of the delivery tray, and hence stacking a large number of the bundles of sheets is disabled, thereby degrading the stacking efficiency.

Thus, there has been known a sheet stacking apparatus having a configuration in which, when the bundles of sheets are to be stacked and received on the delivery tray, a receiving surface of the delivery tray configured to receive the bundles of sheets is inclined along a direction of introducing the bundles of sheets, and the stacked bundles of sheets are pressed by an arm (see Japanese Patent Application Laid-Open No. 2006-143466).

However, according to the related art disclosed in Japanese Patent Application Laid-Open No. 2006-143466, when an area of the receiving surface of the delivery tray configured to stack the sheets thereon is sufficiently larger than a surface area of the sheets, there is a case where sheets subsequently introduced to a portion of the delivery tray having no sheet stacked thereon are moved, while sliding on the inclined receiving surface, to a portion having sheets stacked thereon. In such a case, there is a problem in that the subsequent sheets sliding on the inclined receiving surface hit the sheets having already been stacked.

SUMMARY OF THE INVENTION

The present invention provides a sheet stacking apparatus configured to allow sheets conveyed by a conveyance unit to be stacked on sheets placed on a second region of a stacking unit.

According to one embodiment of the present invention, there is provided a sheet stacking apparatus, comprising:

a conveyance unit configured to convey a sheet;

a stacking unit on which the sheet conveyed by the conveyance unit is stacked, the stacking unit inclined downward in a conveyance direction in which the conveyance unit conveys a sheet and comprising a first region and a second region, the second region being located downstream of the first region in the conveyance direction;

a guide portion configured to guide a sheet conveyed by the conveyance unit over a sheet placed on the second region; and a pressing portion configured to press a sheet placed on the second region.

Further features of the present invention will become apparent from the following description of exemplary embodiments with reference to the attached drawings.

DESCRIPTION OF THE EMBODIMENTS

Now, an exemplary embodiment of the present invention will be described with reference to the drawings.

First, an image forming apparatus 100 to which a sheet stacking apparatus 160 according to the present invention is effectively applicable will be described.

Figure 1:
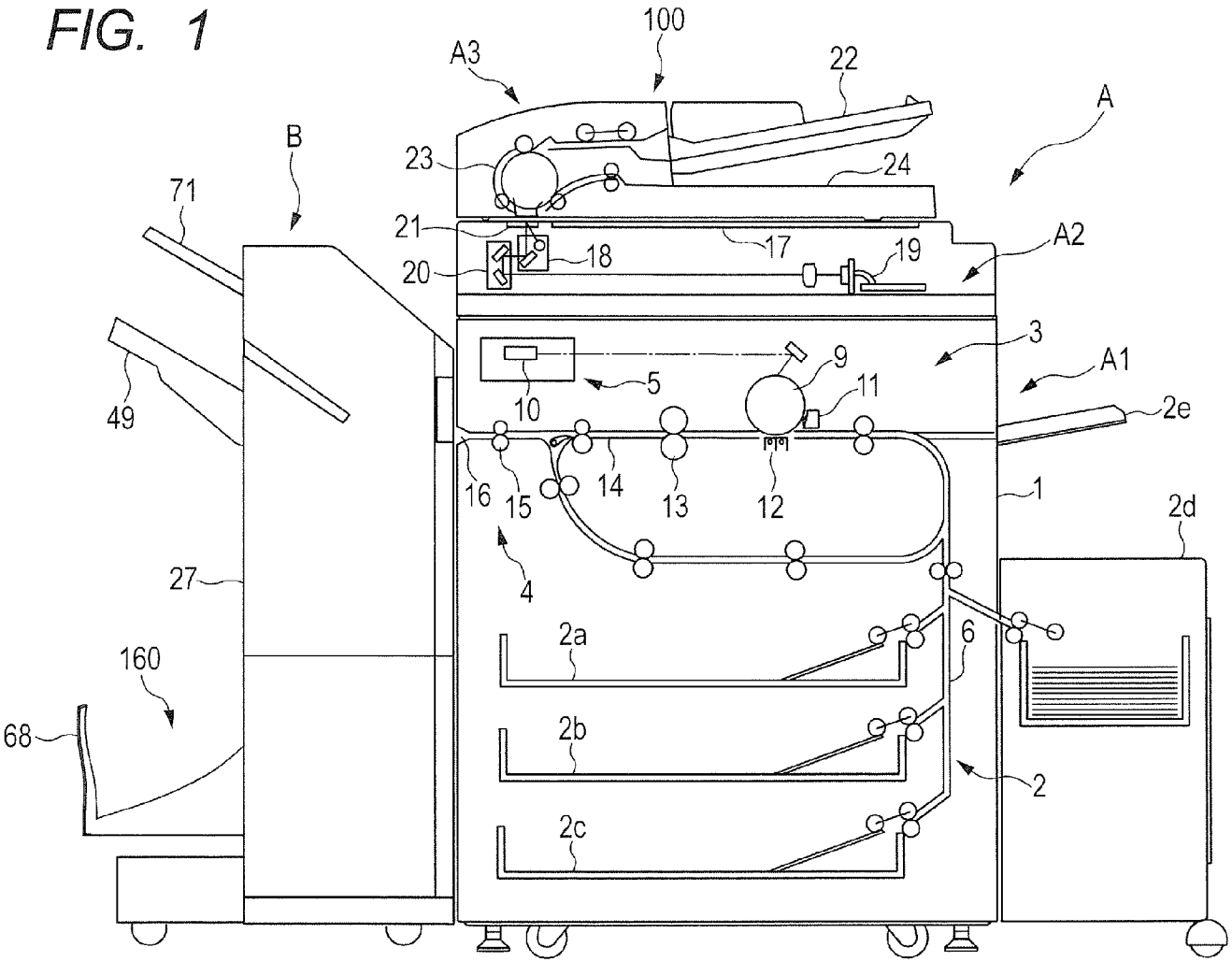
FIG. 1 is an explanatory view for illustrating an entire configuration of an image forming apparatus.

As illustrated in FIG. 1, an image forming apparatus 100 includes an image forming apparatus main body A and a sheet post-processing apparatus B juxtaposed to the image forming apparatus main body A. The image forming apparatus main body A includes an image forming unit A1, a scanner unit A2, and a feeder unit A3. In a main body housing 1, there are provided a sheet feeding portion 2, an image forming portion 3, a sheet delivery portion 4, and a data processing portion 5.

The sheet feeding portion 2 includes cassette mechanisms 2*a*, 2*b*, and 2*c* configured to receive sheets of a plurality of sizes to be subjected to image formation, respectively, and sends out sheets having a size designated by a main body controller (not shown) to a sheet feeding path 6. The cassette mechanisms 2*a*, 2*b*, and 2*c* are removably mounted in the sheet feeding portion 2, and each cassette mechanism includes a separating mechanism configured to separate sheets in the cassette mechanism into individual sheets and a sheet feeding mechanism configured to send out the sheets. On the sheet feeding path 6, there are provided conveyance rollers configured to feed sheets, which are fed from the respective cassette mechanisms 2*a*, 2*b*, and 2*c*, to downstream, and a registration roller pair. The registration roller pair is provided at an end of the sheet feeding path 6 and configured to correct skew feed of sheets.

Further, a large capacity cassette 2*d* and a manual feed tray 2*e* are connected to the sheet feeding path 6. The large capacity cassette 2*d* is an optional unit configured to receive sheets having a size which is consumed in large amounts. The manual feed tray 2*e* is configured to enable supply of special sheets, such as thick sheets, coated sheets, or film sheets, which are difficult to be separated and fed.

The image forming portion 3 is constructed by, for example, an electrostatic printing mechanism, and includes a photosensitive drum 9 to be rotated. At the periphery of the photosensitive drum 9, there are provided a light emitting unit 10 configured to emit an optical beam, a developing unit 11, and a cleaner (not shown). The image forming portion 3 having a monochromatic printing mechanism is illustrated in FIG. 1. A latent image is optically formed on the photosensitive drum 9 by the light emitting unit 10, and the developing unit 11 causes toner to adhere on the latent image.

Then, a sheet is fed from the sheet feeding path 6 to the image forming portion 3 at a timing of forming an image on the photosensitive drum 9, and the toner image is transferred onto the sheet by a transfer charger 12. The toner image is fixed on the sheet by a fixing roller 13 disposed on a sheet delivery path 14. On the sheet delivery path 14, there are arranged a sheet delivery roller 15 and a sheet delivery port 16 to convey the sheet to the sheet post-processing apparatus B described later.

The scanner unit A2 includes a platen 17 on which an original is placed, a carriage 18 configured to reciprocate along the platen 17, a photoelectric converter 19, and a reduction optical system 20 configured to guide light, which is radiated from the carriage 18 and reflected from the original placed on the platen 17, to the photoelectric converter 19. Further, the scanner unit A2 includes a running platen 21 and reads an image of an original, which is fed from the feeder unit A3, with the use of the carriage 18 and the reduction optical system 20. The photoelectric converter 19 is configured to convert optical output from the reduction optical system 20 into image data through photoelectric conversion and output the image data as an electric signal to the image forming portion 3.

The feeder unit A3 includes a feeding tray 22, a feeding path 23 configured to guide an original fed from feeding tray 22 to the running platen 21, and a delivery tray 24 configured to receive the original read through the running platen 21.

Figure 2:
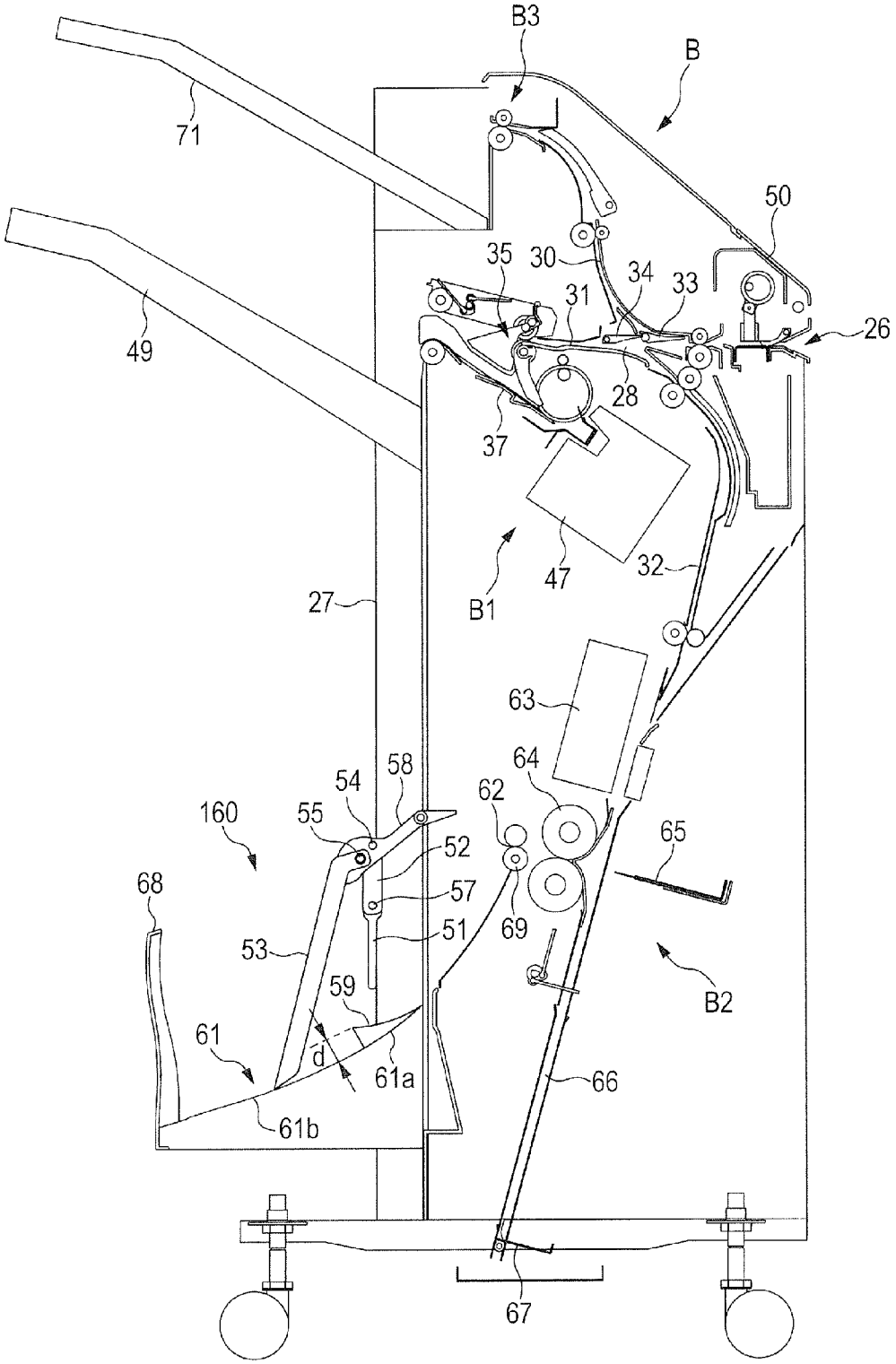
FIG. 2 is an explanatory view for illustrating a configuration of a sheet post-processing apparatus.

FIG. 2 is an illustration of a configuration of the sheet post-processing apparatus B configured to perform post-processing on a sheet, which is conveyed from the image forming apparatus main body A and has an image formed thereon. An apparatus housing 27 of the sheet post-processing apparatus B is disposed so as to have a height size substantially equal to that of the main body housing 1 of the image forming apparatus main body A. A carry-in port 26 of the sheet post-processing apparatus B communicates with the sheet delivery port 16 of the image forming apparatus main body A.

The sheet post-processing apparatus B includes a sheet carry-in path 28 to which a sheet from the carry-in port 26 is introduced, a first sheet delivery path 31, a second sheet delivery path 32, and a third sheet delivery path 30, which are formed to branch out from downstream of the sheet carry-in path 28, a first path-switching device 33, and a second path-switching device 34. The first path-switching device 33 is constructed by a flapper guide configured to change a sheet conveyance direction. The first path-switching device 33 is configured to be switched by a driving device (not shown) into a mode of guiding a sheet from the carry-in port 26 to the third sheet delivery path 30 and a mode of guiding the sheet to a direction toward the first sheet delivery path 31 or the second sheet delivery path 32.

The first sheet delivery path 31 and the second sheet delivery path 32 are arranged to communicate with each other so as to enable switch-back conveyance of reversing the conveyance direction of a sheet which has once been introduced to the first sheet delivery path 31 and introducing the sheet to the second sheet delivery path 32. The second path-switching device 34 is configured to be switched by a driving device (not shown) to a mode of introducing a sheet conveyed from the first path-switching device 33 to the first sheet delivery path 31 and a switch-back conveyance mode of introducing a sheet which has been introduced to the first sheet delivery path 31 to be further introduced to the second sheet delivery path 32. On the sheet carry-in path 28, there is arranged a punching unit 50 configured to form a punch hole in the conveyed sheet.

The sheet post-processing apparatus B includes a first processing unit B1 configured to align, stack, and bind sheets conveyed from the first sheet delivery path 31, a second processing unit B2 configured to perform book binding by bundling sheets conveyed from the second sheet delivery path 32 into a bundle of sheets and performing center folding on the bundle of sheets, and a third processing unit B3 configured to cause sheets conveyed from the third sheet delivery path 30 to be offset by a predetermined amount in an orthogonal direction perpendicular to the conveyance direction. On outside of the apparatus housing 27, there are arranged a first tray 49, a second tray 61, and a third tray 71 on which sheets or bundles of sheets having been subjected to post-processing by the first processing unit B1, the second processing unit B2, and the third processing unit B3 and conveyed therefrom, respectively are stacked.

The first processing unit B1 includes a processing tray 37 configured to align and stack sheets conveyed from the sheet delivery port 35 and a stapler unit 47 configured to perform binding on the stacked bundle of sheets. The processing tray 37 is provided below the sheet delivery port 35 of the first sheet delivery path 31. Sheets carried out from the sheet delivery port 35 are switched back in the sheet conveyance direction and introduced to the processing tray 37. Then, the sheets are positioned at a predetermined binding position on the processing tray 37 by a positioning mechanism and bound by the stapler unit 47. The bound bundle of sheets is delivered to the first tray 49 by a sheet bundle carry-out mechanism.

The third processing unit B3 is configured to perform jog-sorting of causing sheets conveyed to the third sheet delivery path 30 to be offset and sorted in the orthogonal direction, and deliver the sheets to the third tray 71.

The second processing unit B2 is configured to perform center folding on a bundle of sheets, and this center folding is closely related to the present invention. The second processing unit B2 is configured to align and stack sheets sequentially conveyed through the switch-back conveyance from the first sheet delivery path 31, perform binding on a center portion of the bundle of sheets, perform center folding on the bundle of sheets, and introduce the bundle of sheets to the second tray 61. Thus, the second tray 61 serves as a stacking unit configured to stack the center-folded bundle of sheets.

The second processing unit B2 includes a guide member 66 configured to stack sheets to form a bundle, a regulation stopper 67 configured to regulate leading edges of the sheets at a predetermined position on the guide member 66, to thereby position the sheets, a saddle stitching stapling unit 63 configured to perform binding on a center portion of the positioned bundle of sheets, a folding roller pair 64 configured to fold the bundle of sheets at a center portion thereof after the binding, a folding blade 65, and a pair of delivery rollers 69 configured to nip the center-folded bundle of sheets and deliver the center-folded bundle of sheets to the second tray 61.

As disclosed in Japanese Patent Application Laid-Open No. 2008-184324 and Japanese Patent Application Laid-Open No. 2009-051644, in a state in which a bundle of sheets is located between a head unit and an anvil unit, the saddle stitching stapling unit 63 causes the head unit and the anvil unit to move along a center portion (line) of the sheets and performs binding.

Further, during the center folding, the folding blade 65 is inserted, with intervention of a crease of the bundle of sheets, into a nip portion of the folding roller pair 64 held in pressure contact with each other, and the inserted bundle of sheets is folded by rotation of the folding roller pair 64. The pair of rollers constructing the folding roller pair 64 are each formed of a material having a relatively large friction coefficient, such as rubber. For example, using a soft material such as rubber enables accurate conveyance of the bundle of sheets in a rotational direction while folding the bundle of sheets. It is more preferred that the soft material such as rubber be subjected to lining.

An operation of the second processing unit B2 will be described. In response to a job termination signal from the image forming apparatus main body A, the sheets stacked on the guide member 66 are moved so that the center portion of the bundle of sheets is aligned with the saddle stitching stapling unit 63, and then the sheets are bound. After binding at one location or two locations has been completed, the bundle of sheets is moved to a folding position, and then the folding roller pair 64 is rotated. The folding blade 65 is caused to proceed in the folding direction, and then the folding blade 65 is retreated after the folding rollers 64 are rotated by a predetermined amount. After that, the center-folded bundle of sheets is passed to the pair of delivery rollers 69 and nipped therebetween. Rotation of the delivery rollers 69 causes the center-folded bundle of sheets to be delivered through a delivery port 62 of the pair of delivery rollers 69 to the second tray 61 of the sheet stacking apparatus 160. Thus, the pair of delivery rollers 69 constructs a conveyance unit configured to convey the bundle of sheets to the second tray 61.

The second tray (stacking unit) 61 has an upper surface configured to receive the conveyed bundle of sheets and inclined downward along a direction in which the bundle of sheets is introduced (conveyance direction). An engagement portion 68 which stands vertically is provided at a distal end of the second tray 61. The upper surface of the second tray 61 includes a first region 61*a*, which serves as an entry portion to which the bundle of sheets is introduced, and a second region 61*b*, which is located downstream of the first region 61*a* in the conveyance direction and stacks the conveyed bundle of sheets thereon. In the first region 61*a*, there is provided a guide member 59 configured to guide a subsequent bundle of sheets, which is conveyed subsequently to the bundle of sheets arranged on the second region 61*b*, over the bundle of sheets stacked on the second region 61*b*.

Figure 3:
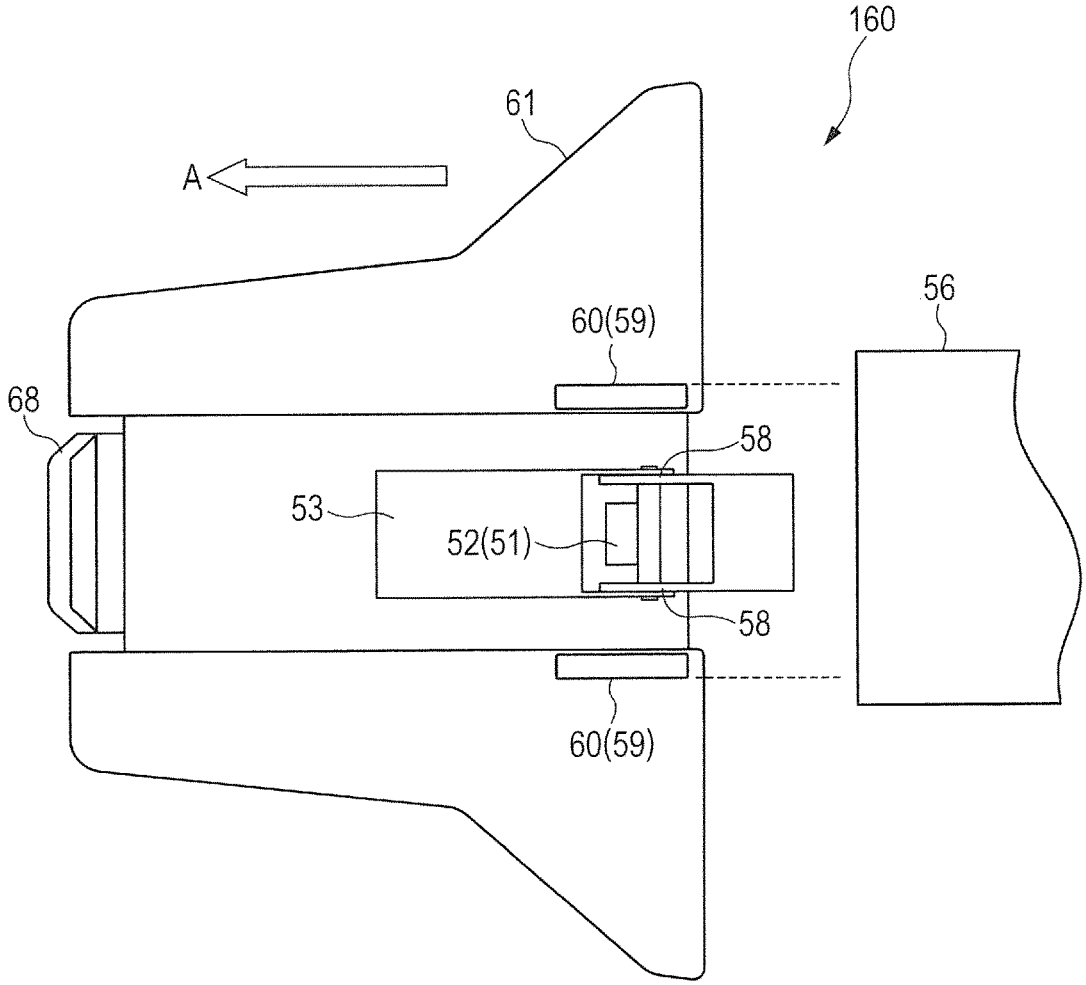
FIG. 3 is a plan view for illustrating a portion of a tray on which sheets are stacked in a sheet stacking apparatus according to the present invention.

As illustrated in FIG. 3, the guide member 59 comprises a pair of ribs 60 arranged so as to be spaced apart in the direction orthogonal to the conveyance direction of the sheets indicated by the arrow A. The pair of ribs 60 extend along the conveyance direction. An installation width (distance) between the pair of ribs 60 of the guide member 59 in the direction orthogonal to the conveyance direction is set within a width of a sheet having a minimum size to be stacked on the second tray 61. In this embodiment, the installation width between the ribs 60 is set to a size substantially equal to a width of the smallest bundle of sheets 56 so that the ribs 60 are located within the width of the bundle of sheets in the direction orthogonal to the conveyance direction of the bundle of sheets to be conveyed. With this, in particular, even a sheet having a small width, which is liable to cause failure in stacking, can be securely stacked on the second tray 61. Further, the ribs 60 are integrally molded of a material, such as resin, same as that of the second tray 61. Alternatively, the ribs 60 may be formed as bodies separated from the second tray 61. When the ribs 60 and the second tray 61 are formed to be separate bodies, and portions (installation portions) for receiving the ribs 60 are provided at a plurality of locations in the direction orthogonal to the conveyance direction of the sheets, the installation width of the ribs 60 can be freely changed in accordance with a sheet width.

Upper surfaces of the ribs 60 form a guide path configured to guide the bundle of sheets conveyed by the delivery rollers 69. The upper surfaces of the ribs 60 have a gradient which gradually declines along the conveyance direction of the bundle of sheets. However, the slope angle of the gradient is set to be smaller than the slope angle of the second tray 61, to thereby provide a step "d" between the rear end (the downstream end in the conveyance direction) of the rib 60 and the second region 61*b*. It is preferred that the shape of the guide path be formed so as to gradually more separate from the upper surface of the second tray 61 in a direction away from the upstream end of the guide path toward downstream along the conveyance direction of the sheets conveyed by the delivery rollers 69. The second tray 61 is inclined downward in the conveyance direction, and hence the heights of the ribs 60 on the side where the sheets are introduced can be set low, thereby being capable of stacking more sheets.

Above the second tray 61, there are provided a first pressing member 51 and a second pressing member 52, which are coupled to each other, and a third pressing member (pressing portion) 53. The first pressing member (upstream pressing portion) 51 and the second pressing member (upstream pressing portion) 52 press the bundle of sheets stacked on the second tray 61 upstream of the third pressing member 53 in the conveyance direction. The second pressing member 52 and the third pressing member 53 are supported in a pivotable manner by rotation shafts (pivot supporting points) 54 and 55, respectively. As illustrated in FIG. 2, the rotation shafts 54 and 55 are mounted respectively on a pair of protruding pieces 58 which are provided so as to protrude outward from the apparatus housing 27. Further, the first pressing member (first pressing portion) 51 is coupled, at an upper end thereof, to a lower end of the second pressing member (second pressing portion) 52 by a coupling shaft 57, and is rotatable about the coupling shaft 57 as a supporting point (coupling shaft supporting point). The rotation shaft (pivot supporting point) 54 is provided above the second tray 61 and upstream of the downstream ends of the ribs 60 in the conveyance direction.

The third pressing member 53 has a larger size in the longitudinal direction than the first and second pressing members 51 and 52 which are coupled to each other, and is supported by the rotation shaft 55 in a state of extending obliquely downward toward the upper surface of the second tray 61. Meanwhile, the first and second pressing members 51 and 52 are mounted so as to be suspended by a biasing member such as a weight (not shown) in the substantially vertical direction toward the upper surface of the second tray 61. Thus, the stack height when the first pressing member 51 presses the sheets stacked on the upper surface in the second region 61*b* of the second tray 61 is set to be lower than the stack height when the second pressing member 52 presses the sheets.

When the bundle of sheets 56 is nipped by the pair of delivery rollers 69 and delivered through the delivery port 62, a folded portion as a leading edge of the bundle of sheets 56 is first brought into abutment against the upper surfaces of the ribs 60 of the guide member 59 and moved toward the second region 61*b* while sliding on the gradient of the guide path on the upper surface. Then, the bundle of sheets 56 is moved over the second region 61*b* while pushing away the first and second pressing members 51 and 52, aligned by the engagement portion 68 of the second tray 61, and then stacked on the second tray 61.

The downstream ends of the ribs 60 in the sheet conveyance direction are arranged between the first and second pressing members 51 and 52 and the third pressing member 53. The first and second pressing members 51 and 52 are arranged upstream of the downstream ends of the ribs 60 in the sheet conveyance direction, and mounted so as to be suspended in the substantially vertical direction toward the upper surface of the second tray 61, thereby being capable of securely guiding the bundle of sheets 56 to the upper surface of the ribs 60 of the guide member 59.

Further, the downstream ends of the ribs 60 in the sheet conveyance direction and the position of the first pressing member 51 in the sheet conveyance direction are arranged close to each other. With this, opening of the open edge of the bundle of sheets 56 stacked on the downstream ends of the ribs 60 in the sheet conveyance direction can be suppressed.

Figure 4:
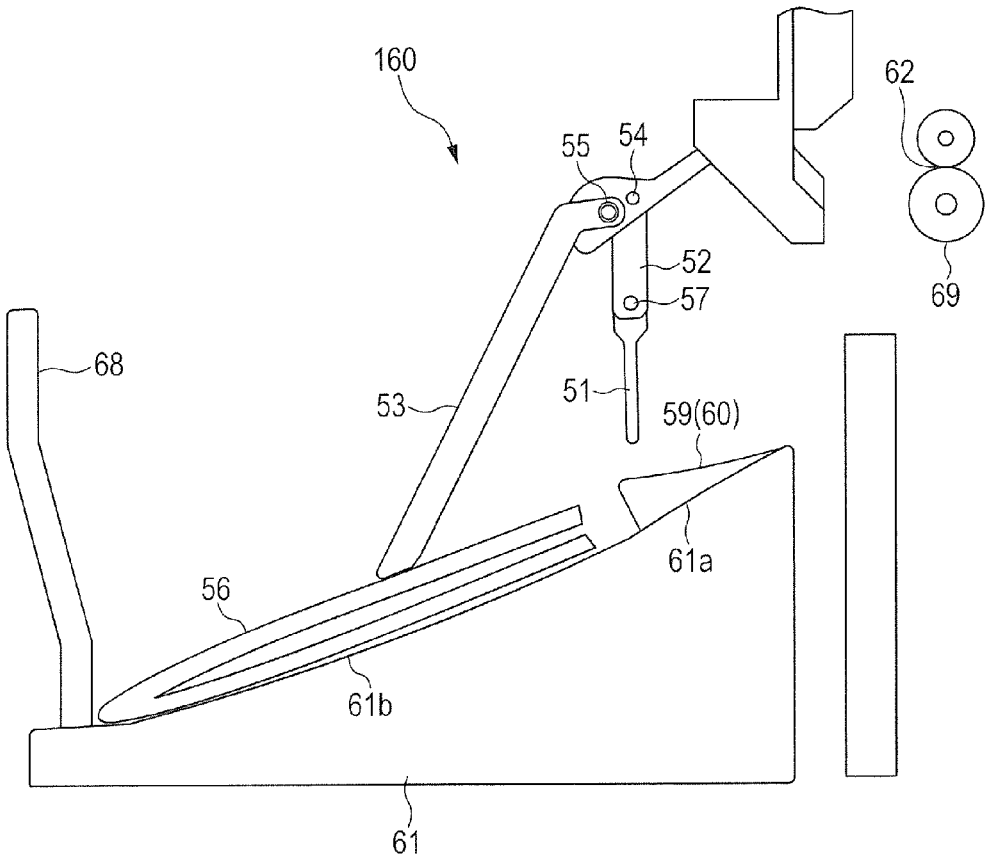
FIG. 4 is a schematic view for illustrating an operation which is performed when a center-folded bundle of sheets is introduced to the tray in the sheet stacking apparatus according to the present invention.

FIG. 4 is an illustration of a state in which the bundle of sheets 56 is placed on the second region 61*b* of the second tray 61. In the example illustrated in FIG. 4, a surface area of the bundle of sheets 56 is smaller than a stackable surface area of the second tray 61, and hence the edge of the bundle of sheets 56 is not in contact with the guide member 59 when the bundle of sheets 56 is placed on the second region 61*b*. As described above, when the bundle of sheets 56 having a small size in the conveyance direction is placed on the second region 61*b*, the third pressing member (pressing portion) 53 is brought into abutment against the center portion of the bundle of sheets 56 placed on the second region 61*b* and evenly presses the center portion, thereby preventing opening of the open edge, which is a side opposite to the crease portion (spine) on the folded side.

Figure 5:
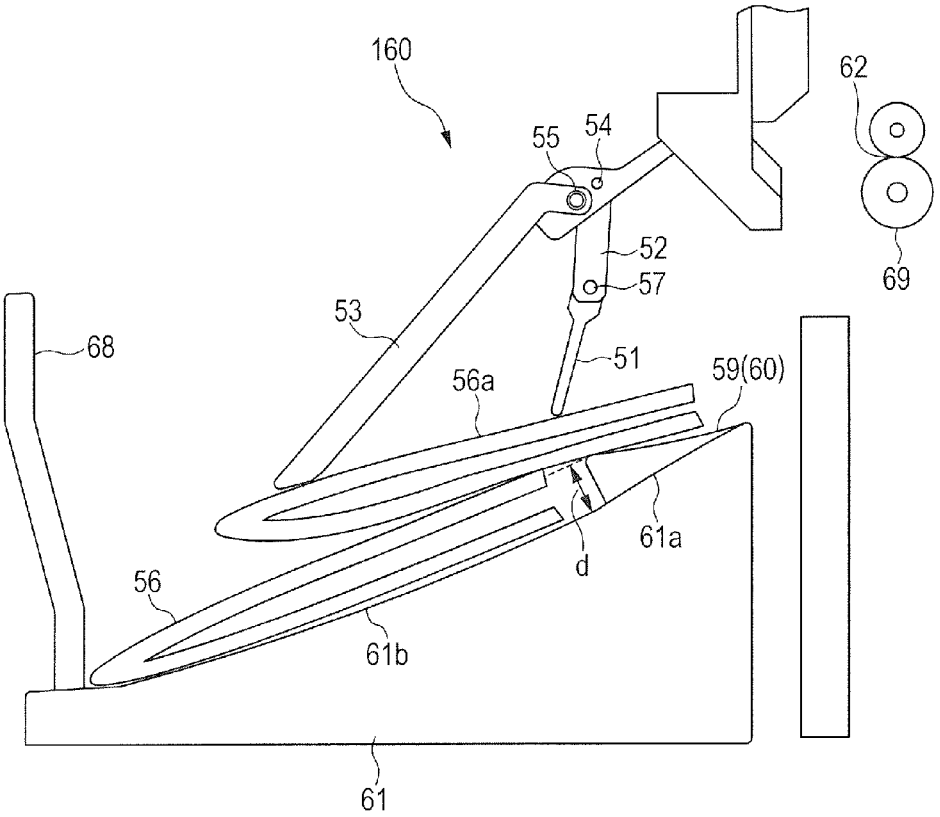
FIG. 5 is a schematic view for illustrating a state in which a subsequent bundle of sheets is introduced from the state of FIG. 4.

FIG. 5 is an illustration of a state in which a subsequent bundle of sheets 56*a* is introduced to the second tray 61 in the state of FIG. 4. At this time, the bundle of sheets 56*a* is brought into abutment against the first and second pressing members 51 and 52 and moves while pushing away the first and second pressing members 51 and as described above. The bundle of sheets 56*a* is regulated by the first and second pressing members 51 and 52, and hence the bundle of sheets 56*a* slides on the upper surfaces of the ribs 60 while maintaining the posture of the bundle of sheets 56*a* when being introduced.

Then, when the bundle of sheets 56*a* reaches the rear ends (downstream ends) of the ribs 60 in the conveyance direction, the bundle of sheets 56*a* is introduced to the second region 61*b* from a high position of the step "d", and hence the bundle of sheets 56*a* is guided over the bundle of sheets 56 stacked on the second region 61*b*. With this, occurrence of hitting sound caused by a leading edge of the bundle of sheets 56*a* hitting the bundle of sheets 56 and alignment failure at the time of sheet jamming or sheet stacking can be prevented. Further, even when the open edge of the bundle of sheets 56 is opened to some extent due to insufficient center folding on the stacked bundle of sheets 56, entry of the subsequent bundle of sheets 56*a* between sheets of the bundle of sheets 56 can also be prevented.

In the sheet stacking apparatus 160, the guide member 59 is provided in the first region 61*a* on the entry side of the second tray 61, and the subsequent bundle of sheets 56*a* is guided by the guide member 59 over the bundle of sheets 56 stacked on the second region 61*b* on the downstream side of the second tray 61, thereby being capable of stacking the bundles of sheets in the aligned state.

In the embodiment, the guide member 59 comprises the pair of ribs 60. However, the guide member 59 may comprise one rib or three or more ribs. In the case where one rib is provided, it is necessary to set the width size of the rib in the direction orthogonal to the conveyance direction to be substantially equal to the width size of the bundle of sheets 56 having the smallest width size.

Further, the material of the rib is also not limited to the material same as that of the second tray 61, and bent wires may be mounted on the upper surface of the first region 61*a*. In the case of a bundle of sheets having a large size in the conveyance direction and extending from the second region 61*b* to the first region 61*a* when the bundle of sheets is stacked on the second tray 61, the bundle of sheets is stacked also on the guide member 59. When such a bundle of sheets having a large size is to be processed, constructing the guide member 59 with the wires gives elasticity to the guide member 59, and hence the guide member 59 is flexed by the weight of a group of stacked bundles of sheets 56, thereby producing the effect of increasing the stackable number of sheets.

Further, other than the configuration of allowing the bundle of sheets to slide and move utilizing the shape of the guide member 59, the guide member 59 may comprise, for example, a lever (not shown) configured to move in and out upward from the upper surface of the second tray 61 at the positions of the downstream ends of the ribs 60 in the sheet conveyance direction. The lever (not shown) is moved in and out by a spring member or a driving device (not shown) such as a solenoid motor.

The lever may stand by with its distal end located at a height position equal to or lower than that of the upper surface of the tray 61, and be caused to project at the timing when a leading edge of the subsequent bundle of sheets 56*a* to be conveyed passes above the lever, to thereby guide the subsequent bundle of sheets 56*a* over the bundle of sheets 56 stacked on the second region 61*b*.

Further, a hole may be formed in the upper surface of the second tray 61 at a position which is the same as the position of the lever and is located at the downstream ends of the ribs 60 in the conveyance direction, and a fan may be provided in the second tray 61, to thereby send air from the fan through the hole to blow the air upward. As in the lever described above, the fan can be rotated at the timing when the leading edge of the subsequent bundle of sheets 56*a* to be conveyed passes above the hole, to thereby guide the subsequent bundle of sheets 56*a* over the bundle of sheets 56 stacked on the second region 61*b*.

According to the embodiment, sheets which are sequentially introduced can be securely stacked in the aligned state on the predetermined region of the stacking unit. Sheets which are subsequently conveyed are guided by the guide member over a rear edge of the sheets having already been stacked on the stacking unit, thereby being capable of preventing occurrence of jamming or stack alignment failure due to the subsequent sheets hitting the sheets having already been stacked.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-177132, filed Sep. 9, 2015, which is hereby incorporated by reference herein in its entirety.

What is claimed is:

1. A sheet stacking apparatus, comprising:

a conveyance unit configured to convey a sheet;

a stacking unit on which the sheet conveyed by the conveyance unit is stacked, the stacking unit inclined downward in a conveyance direction in which the conveyance unit conveys the sheet and comprising a first region and a second region, the second region being located downstream of the first region in the conveyance direction;

a pressing portion having a pressing section configured to press the sheet on the first region, a first portion being a most downstream portion of the pressing section in the conveyance direction; and a guide portion configured to guide the sheet conveyed by the conveyance unit over a preceding sheet placed on the second region, the preceding sheet having been conveyed by the conveyance unit before the sheet, an upstream edge, in the conveyance direction, of the preceding sheet being located in the second region, a second portion being a most downstream portion of the guide portion in the conveyance direction, the second portion being configured to guide the sheet conveyed by the conveyance unit over the preceding sheet placed on the second region, wherein in a case where the sheet is not on the stacking unit, the first portion is located upstream, in the conveyance direction, of the second portion.

2. A sheet stacking apparatus according to claim 1, wherein the guide portion is arranged at the stacking unit.

3. A sheet stacking apparatus according to claim 2, wherein the guide portion is arranged at the first region.

4. A sheet stacking apparatus according to claim 1, further comprising a downstream pressing portion configured to press the sheet placed on the second region, wherein the downstream pressing portion has a downstream pressing section configured to press the sheet on the stacking unit, and wherein a third portion which is a most downstream portion of the downstream pressing section in the conveyance direction is located downstream of the second portion in the conveyance direction.

5. A sheet stacking apparatus according to claim 4, wherein the pressing portion has a pivot supporting point located above the stacking unit and upstream of the second portion in the conveyance direction.

6. A sheet stacking apparatus according to claim 5, wherein the pressing portion is directed toward the guide portion so as to guide the sheet conveyed by the conveyance unit toward the guide portion.

7. A sheet stacking apparatus according to claim 5, wherein the pressing portion comprises:

a coupling shaft supporting point arranged between a lower end on a side of the stacking unit and the pivot supporting point;

a first pressing portion provided between the lower end and the coupling shaft supporting point; and a second pressing portion provided between the coupling shaft supporting point and the pivot supporting point, wherein the first pressing portion is coupled to the second pressing portion at the coupling shaft supporting point in a pivotable manner, and wherein the first pressing portion and the second pressing portion are configured to press, at different heights, the sheet placed on the second portion.

8. A sheet stacking apparatus according to claim 1, wherein the guide portion is inclined downward in the conveyance direction.

9. A sheet stacking apparatus according to claim 4, wherein the downstream pressing portion is operable independently of the pressing portion.

10. A sheet stacking apparatus according to claim 1, further comprising a folding portion configured to fold the sheet, wherein the sheet folded by the folding portion is conveyed to the stacking unit by the conveyance unit.

11. A sheet stacking apparatus according to claim 1, wherein a step is provided between the second portion and the second region.

* * * * *